US011781362B2

(12) United States Patent
Lee

(10) Patent No.: US 11,781,362 B2
(45) Date of Patent: Oct. 10, 2023

(54) MULTI-LINK DOOR HINGE

(71) Applicant: SEO WON KOREA CO., LTD, Gimhae-si (KR)

(72) Inventor: June Young Lee, Busan (KR)

(73) Assignee: SEO WON KOREA CO., LTD.

( * ) Notice: Subject to any disclaimer, the term of this patent is extended or adjusted under 35 U.S.C. 154(b) by 181 days.

(21) Appl. No.: 17/401,550

(22) Filed: Aug. 13, 2021

(65) Prior Publication Data

US 2021/0372187 A1 Dec. 2, 2021

Related U.S. Application Data

(63) Continuation of application No. PCT/KR2020/010645, filed on Aug. 12, 2020.

(30) Foreign Application Priority Data

Jan. 3, 2020 (KR) ..... 10-2020-0000645

(51) Int. Cl.
*E05F 1/08* (2006.01)
*E05F 3/20* (2006.01)
(Continued)

(52) U.S. Cl.
CPC ..... *E05F 3/20* (2013.01); *E05D 3/06* (2013.01); *E05D 11/1028* (2013.01); *E05F 5/02* (2013.01);
(Continued)

(58) Field of Classification Search
CPC ... E05F 1/08; E05F 1/10; E05F 1/1041; E05F 1/1091; E05F 1/12; E05F 1/1223;
(Continued)

(56) References Cited

U.S. PATENT DOCUMENTS 3,906,587 A * 9/1975 Little ..... E05F 1/1261 16/289
7,240,974 B2 * 7/2007 Hirtsiefer ..... E05F 1/1058 312/109
(Continued)

FOREIGN PATENT DOCUMENTS

CN 207633915 U 7/2018
DE 102006007702 A1 * 8/2007 ..... E05D 15/46
(Continued)

OTHER PUBLICATIONS

Korean Notice of Allowance (KR 10-2020-0000645), KIPO, dated Jul. 17, 2020.
(Continued)

*Primary Examiner* — Chuck Y Mah
(74) *Attorney, Agent, or Firm* — Park & Associates IP Law Office

(57) ABSTRACT

A multi-link door hinge is proposed. The multi-link door hinge includes: a main body frame provided in a main body of an apparatus having a door; a door frame provided on the door; a body frame rotatably connected to one side portion of the main body frame; an inner link and an outer link rotatably connecting the door frame to the body frame; a leaf spring link rotatably connecting the main body frame to the outer link; an upper cam coupled to a portion connecting the body frame to the inner link in a co-rotatable manner, provided between first and second side portions of a sidewall of the inner link, and securely coupled to the body frame; an upper elastic member having a first side portion provided inside the inner link and a second side portion rollably coupled to the upper cam and elastically supporting the door frame.

8 Claims, 14 Drawing Sheets

(51) Int. Cl.
*E05D 3/06* (2006.01)
*E05D 11/10* (2006.01)
*E05F 5/02* (2006.01)

(52) U.S. Cl.
CPC ..... *E05Y 2201/212* (2013.01); *E05Y 2900/20* (2013.01); *E05Y 2900/30* (2013.01)

(58) Field of Classification Search
CPC ..... E05F 1/1246; E05F 1/1253; E05F 1/1261; E05F 1/1292; E05F 1/14; E05F 3/20; E05F 3/18; E05F 5/02; E05D 11/1021; E05D 3/06; E05D 3/12; E05D 3/14; E05D 3/16; E05D 3/18; E05D 11/10; E05D 11/1028; E05D 15/40; E05D 15/401; E05D 15/405; E05D 15/406; E05D 15/42; E05D 15/58; E05D 15/565; E05D 2003/163; E06B 3/5045; E05Y 2800/22; E05Y 2900/20; E05Y 2900/202; E05Y 2900/208; E05Y 2900/21; E05Y 2900/30; E05Y 2201/21; E05Y 2201/264; E05Y 2201/212; E05Y 2201/604
See application file for complete search history.

(56) References Cited

U.S. PATENT DOCUMENTS 7,987,558 B2 * 8/2011 Beckmann ..... E05F 1/1253 16/366
8,296,906 B2 * 10/2012 Wisniewski ..... E05D 3/14 16/302
10,704,311 B1 * 7/2020 Collene ..... E05F 1/1261
11,319,740 B2 * 5/2022 Byun ..... E05F 3/20
2014/0130302 A1 * 5/2014 Bettinzoli ..... E05F 5/02 16/304
2014/0145576 A1 * 5/2014 White ..... A47B 96/00 312/319.1
2015/0330128 A1 * 11/2015 Ng ..... E05D 7/125 16/65
2015/0361709 A1 12/2015 Stuke
2016/0348919 A1 * 12/2016 Ivanovic ..... E05F 1/1246
2019/0169902 A1 * 6/2019 Hu ..... E05F 1/14
2019/0323276 A1 * 10/2019 Vanini ..... E05F 1/1261
2021/0270071 A1 * 9/2021 Salice ..... E05F 5/006

FOREIGN PATENT DOCUMENTS

KR 100142057 B1 7/1998
KR 1020070101298 A 10/2007
KR 101971950 B1 4/2019
KR 102140551 B1 8/2020

OTHER PUBLICATIONS

International Search Report (PCT/KR2020/010645), WIPO, dated Nov. 3, 2020.

* cited by examiner

MULTI-LINK DOOR HINGE

REFERENCE TO RELATED APPLICATIONS

This is a continuation of International Patent Application PCT/KR2020/010645 filed on Aug. 12, 2020, which designates the United States and claims priority of Korean Patent Application No. 10-2020-0000645 filed on Jan. 3, 2020, the entire contents of which are incorporated herein by reference.

FIELD OF THE INVENTION

The present disclosure relates to a multi-link door hinge capable of facilitating opening and closing of a door of an apparatus such as home appliances and furniture.

BACKGROUND OF THE INVENTION

In general, an apparatus such as home appliances and furniture having a door has a door hinge-connected to a main body of the apparatus to open and close the main body, and thus opening and closing the main body as the door rotates.

Recently, as built-in home appliances and refrigerators become larger, the size of a door of the product also increases, so a rotation range of the door with respect to a main body also increases. As a result, limitation in space equipped with refrigerator is caused, so a need for reduction of a door rotation space when the door rotates from the main body is increasing in order to reduce a required space to open and close the door.

In addition, there is a need for hinge technique for providing convenience to a user during opening and closing the door, and a demand for hinge technique capable of facilitating door opening and closing is increasing.

SUMMARY OF THE INVENTION

Accordingly, the present disclosure has been made keeping in mind the above problem occurring in the related art, and an objective of the present disclosure is to provide a multi-link door hinge capable of facilitating door opening and closing and of providing convenience to a user when the user opens and closes a door.

In addition, other objectives and advantages of the present disclosure will be described below, and it may be encompassed in a broader scope by means and combinations within the scope that can be easily derived from the disclosure of the matters and embodiments described in the claims of the present disclosure.

In order to accomplish the above objective, the present disclosure provides a multi-link door hinge, the multi-link door hinge including: a main body frame provided in a main body of an apparatus having a door; a door frame provided on the door; a body frame rotatably connected to one side portion of the main body frame; an inner link and an outer link rotatably connecting the door frame to the body frame; a leaf spring link rotatably connecting the main body frame to the outer link; an upper cam coupled to a portion connecting the body frame to the inner link in a co-rotatable manner, the upper cam being provided between first and second side portions of a sidewall of the inner link to be securely coupled to the body frame; and an upper elastic member having a first side portion provided inside the inner link and a second side portion rollably coupled to the upper cam and configured to elastically support the door frame, wherein an upper cam profile may be formed on an outer circumferential edge of the upper cam, the upper cam profile having a first recessed portion configured to detect a full-closed state of the door in response to a closing motion of the door, a second recessed portion configured to detect a full-open state of the door in response to an opening motion of the door, and a first flat portion connecting the first recessed portion to the second recessed portion.

As a second embodiment of the present disclosure, a multi-link door hinge may include: a main body frame provided in a main body of an apparatus having a door; a door frame provided on the door; a body frame rotatably connected to one side portion of the main body frame; an inner link and an outer link rotatably connecting the door frame to the body frame; a leaf spring link rotatably connecting the main body frame to the outer link; a lower cam provided in the leaf spring link connected to the outer link; and a lower elastic member having a first side portion provided at a portion connecting the door frame to the outer link and a second side portion coupled to the lower cam in a slidingly movable manner, and being configured to elastically support the door frame, an lower cam profile may be formed on an outer circumferential edge of the lower cam, the lower cam profile having a third recessed portion configured to detect a full-closed state of the door in response to a closing motion of the door, a fourth recessed portion configured to detect a full-open state of the door in response to an opening motion of the door, and a second flat portion connecting the third recessed portion to the fourth recessed portion.

As a third embodiment of the present disclosure, a multi-link door hinge may include: a main body frame provided in a main body of an apparatus having a door; a door frame provided on the door; a body frame rotatably connected to one side portion of the main body frame; an inner link and an outer link rotatably connecting the door frame to the body frame; a leaf spring link rotatably connecting the main body frame to the outer link; an upper cam coupled to a portion connecting the body frame to the inner link in a co-rotatable manner, the upper cam being provided between first and second side portions of a sidewall of the inner link to be securely coupled to the body frame; a lower cam provided in the leaf spring link connected to the outer link; an upper elastic member having a first side portion provided inside the inner link and a second side portion rollably coupled to the upper cam, and being configured to elastically support the door frame; and a lower elastic member having a first side portion provided at a portion connecting the door frame to the outer link and a second side portion coupled to the lower cam in a slidingly movable manner, and being configured to elastically support the door frame, wherein an upper cam profile may be formed on an outer circumferential edge of the upper cam, the upper cam profile having a first recessed portion configured to detect a full-closed state of the door in response to a closing motion of the door, a second recessed portion configured to detect a full-open state of the door in response to an opening motion of the door, and a first flat portion connecting the first recessed portion to the second recessed portion, and an lower cam profile may be formed on an outer circumferential edge of the lower cam, the lower cam profile having a third recessed portion configured to detect a full-closed state of the door in response to a closing motion of the door, a fourth recessed portion configured to detect a full-open state of the door in response to an opening motion of the door, and a second flat portion connecting the third recessed portion to the fourth recessed portion.

The upper elastic member may include: a rod having a first side portion inserted into an installation hole provided in a fixation plate installed in the inner link; a pair of roller brackets provided at a second side portion of the rod; a roller rotatably provided between the roller brackets; and a spring inserted over the rod, and configured to provide pushing force toward the upper cam while a first side portion thereof is supported by the fixation plate and a second side portion thereof is in close contact with the pair of roller brackets.

The lower elastic member may include: a casing having a first side portion provided at the portion connecting the door frame to the outer link and a second side portion fixed to the outer link; a locked portion provided in the casing and coupled to the lower cam in a sliding-movable manner; and a spring provided in the casing, and configured to provide pushing force toward the lower cam while a first side portion thereof is supported by the casing and a second side portion thereof is in close contact with the locked portion.

A cylindrical cam may be provided on a shaft of the main body frame and the body frame, and a bumper protrusion may be formed on an outer circumferential surface of the cylindrical cam along a tangential direction and configured to be brought in contact with the main body frame before the door is closed.

As described above, the present disclosure can provide effects as follows.

The multi-link door hinge can facilitate door opening and closing, allow a user to detect a door state before opening and closing the door, secure precise opening and closing motions of the door, and provide a user-detectable feeling to the user in various ways.

Moreover, the multi-link door hinge realizes a shock absorbing function during door closing, so that improvement in durability of the door can be expected.

In addition, other effects of the present disclosure can be broader by not only the embodiments described above and disclosure in the claims of the present disclosure, but also by effects that can occur within the scope that can be easily followed from the embodiments and the accompanying claims and by possibilities of potential advantages contributing to industrial development.

DETAILED DESCRIPTION OF THE INVENTION

Figure 1:
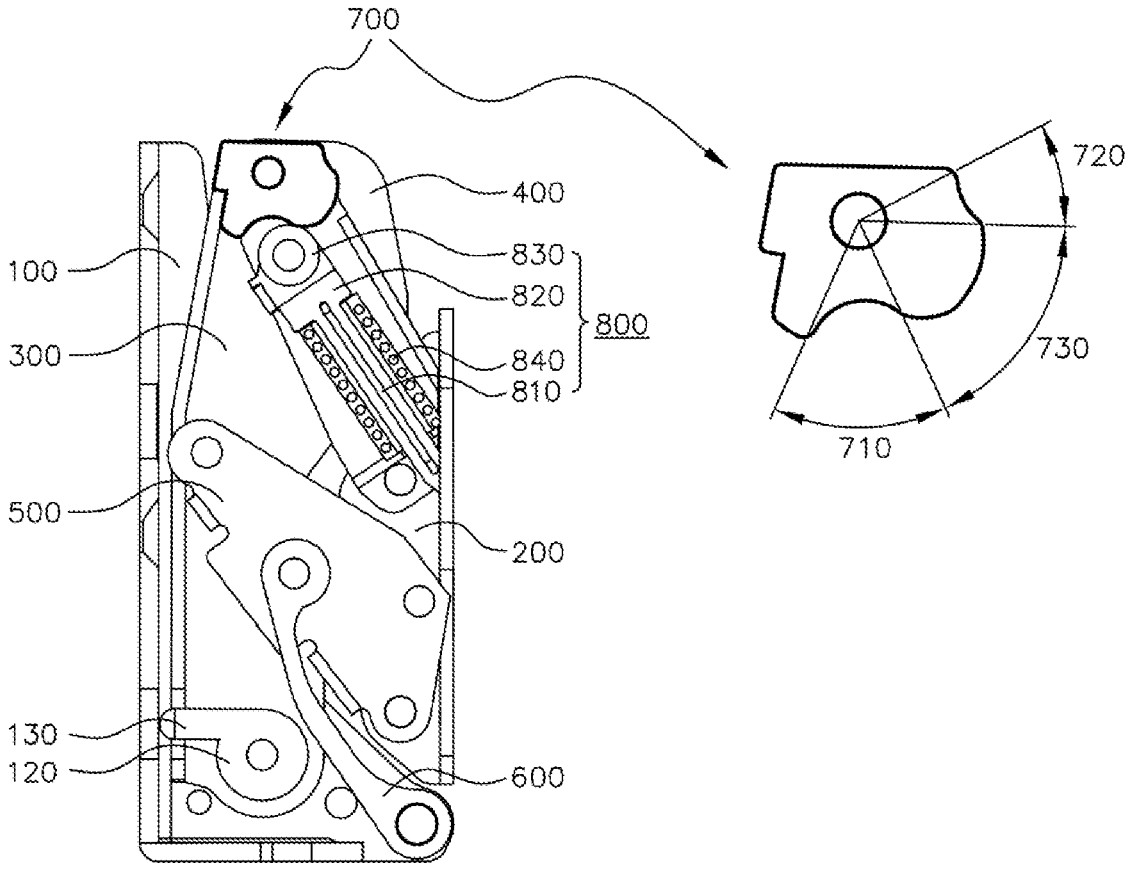
FIGS. 1 to 4 are sectional views stepwisely showing operational states of opening a multi-link door hinge according to a first embodiment of the present disclosure from a door state before closing.

Hereinbelow, preferred embodiments of the present disclosure will be described in detail with reference to the accompanying drawings.

Prior to the description, advantages and features of the present disclosure and methods for achieving them will be more clearly understood from the following detailed embodiments with reference to the accompanying drawings. The terminology used herein is for the purpose of describing particular aspects (or embodiments) only and is not intended to be limiting of the present disclosure. As used herein, the singular forms are intended to include the plural forms as well, unless the context clearly indicates otherwise. A word indicating a direction is provided for the understanding of the description and may be changed on the basis of a viewpoint.

The present disclosure is intended to provide a multi-link door hinge. The multi-link door hinge of the present disclosure is configured to facilitate door opening and closing of an apparatus such as home appliances and furniture and to allow a user to detect a door state before opening or closing, thus providing user convenience. Hereinbelow, the present disclosure will be described in detail with reference to accompanying drawings.

FIGS. 1 to 4 are sectional views stepwisely showing operational states of opening a multi-link door hinge according to a first embodiment of the present disclosure from a door state before closing.

As shown in the drawings, the multi-link door hinge of the present disclosure includes a main body frame 100, a door frame 200, a body frame 300, an inner link 400, an outer link 500, a leaf spring link 600, an upper cam 700, and an upper elastic member 800.

The main body frame 100 is provided at a main body of the apparatus having a door. The main body frame 100 includes an "L"-shaped angle plate coupled to the main body, and a sidewall provided at both sides of the angle plate. The body frame 300, the inner link 400, the outer link 500, and the leaf spring link 600 may be folded between the sidewall of the main body frame 100 due to a closing motion of the door.

The door frame 200 includes a top plate coupled to a surface near a corner of the door and a sidewall provided at both sides of the top plate. The inner link 400 and the outer link 500 may be folded between the sidewall of the door frame 200 due to the closing motion of the door.

The body frame 300 includes a sidewall provided at both sides thereof and a bottom plate connect-supporting the sidewall. One side portion of the sidewall of the body frame 300 is inserted in one side portion of the sidewall of the main body frame 100 and rotatably coupled to the main body frame 100 around a shaft (main shaft). Accordingly, the body frame 300 serves as a main frame in hinge operation of the door.

Opposite ends of the inner link 400 and opposite ends of the outer link 500 are inserted in the sidewall of the door frame 200 and the sidewall of the body frame 300, respectively. The inner link 400 and the outer link 500 may be connected to the door frame 200 and the body frame 300 to be co-rotatable with respect to each other. Accordingly, the inner link 400 and the outer link 500 may be folded and unfolded between the door frame 200 and the body frame 300.

The outer link 500 includes a sidewall provided at both sides thereof and a structure forming connection of the sidewall thereof to be firm. A first side portion of the sidewall of the outer link 500 is rotatably shaft-coupled to a first side portion of the sidewall of the door frame 200, and a second side portion of the sidewall of the outer link 500 is rotatably shaft-coupled to a central portion of the sidewall of the body frame 300.

The inner link 400 includes a sidewall provided at both sides thereof and a bottom plate connect-supporting the sidewall thereof. A first side portion of the inner link 400 is rotatably shaft-coupled to a second side portion of the door frame, and a second side portion of the inner link 400 is rotatably shaft-coupled to a second side portion of the body frame 300.

The leaf spring link 600 has a first side portion rotatably shaft-coupled to a first end of the main body frame, and a second side portion rotatably shaft-coupled to a central portion of the sidewall of the outer link 500. Therefore, the door may be prevented from deviating from a turning radius of the body frame 300 and the heavy weight of the door may be supported.

Meanwhile, the upper cam 700 is coupled to a portion connecting the body frame 300 to the inner link 400 in a co-rotatable manner. The upper cam 700 is located between the first and second side portions of the sidewall of the inner link 400 and is securely coupled to the body frame 300. More preferably, the upper cam 700 is securely coupled to the sidewall of the body frame 300 and the bottom plate connect-supporting the sidewall of the body frame 300.

According to the present disclosure, the multi-link door hinge includes the upper elastic member 800. The upper elastic member 800 has a first side portion provided in the inner link 400 and a second side portion rollably coupled to the upper cam 700 so as to elastically support the door frame 200.

Figure 5:
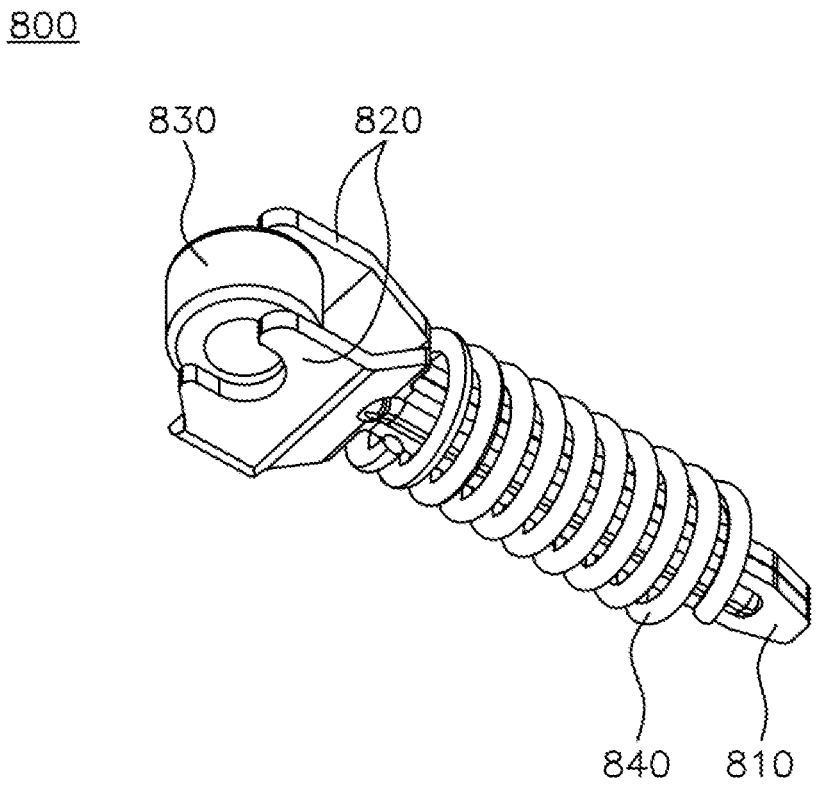
FIG. 5 is a detailed view showing an upper elastic member of the multi-link door hinge according to the first embodiment of the present disclosure.

FIG. 5 is a detailed view showing an upper elastic member of the multi-link door hinge according to the first embodiment of the present disclosure.

As shown in the drawing, the upper elastic member 800 includes a rod 810, a pair of roller brackets 820, a roller 830, and a spring 840.

Referring to FIGS. 1 and 5, a first side portion of the rod 810 is inserted in an installation hole formed in a fixation plate provided in the inner link 400. The pair of roller brackets 820 is provided at a second side portion of the rod 810. The roller 830 is rotatably provided between the roller brackets 820.

The spring 840 is inserted over the rod 810. A first side portion of the spring is supported by the fixation plate provided in the inner link 400 and a second side portion of the spring is in close contact with the pair of roller brackets 820 so as to supply a pushing force toward the upper cam 700.

According to the present disclosure, an upper cam profile is formed on an outer circumference of the upper cam 700, as shown in the right side in FIG. 1. The upper cam profile includes a first recessed portion 710 detecting a full-closed state of the door in response to the door closing motion, a second recessed portion 720 detecting a full-open state of the door in response to an door opening motion, and a first flat portion 730 connecting the first recessed portion to the second recessed portion.

Therefore, when the door is in the opening motion and the closing motion, the roller 830 of the upper elastic member 800 is rollably moved along the upper cam profile formed on the outer circumference of the upper cam 700. Accordingly, the door is easily opened and closed and the user can detect a door state before opening and closing the door, so the hinge of the present disclosure provides user convenience.

Therefore, the first recessed portion 710 and the second recessed portion 720 may be preferably formed in a curved-recessed shape. The first recessed portion 710 and the second recessed portion 720 may be preferably connected to each other by the first flat portion 730. The first flat portion 730 means a section where a radius of the upper cam 700 is not changed around a shaft connecting the body frame 300 to the inner link 400 in the co-rotatable manner.

Hereinbelow, based on the above description, a moving process of the multi-link door hinge according to the first preferred embodiment of the present disclosure will be described with reference to FIGS. 1 to 4.

As shown in FIG. 1, when the user pulls the door for opening the door, the body frame 300 is pulled by the inner link 400 and the outer link 500 rotatably connected to the door frame 200, so that the body frame 300 comes out of the main body frame 100. Then, at the same time, the roller 830 of the upper elastic member 800 begins to come out of the first recessed portion 710 of the upper cam 700.

Figure 2:
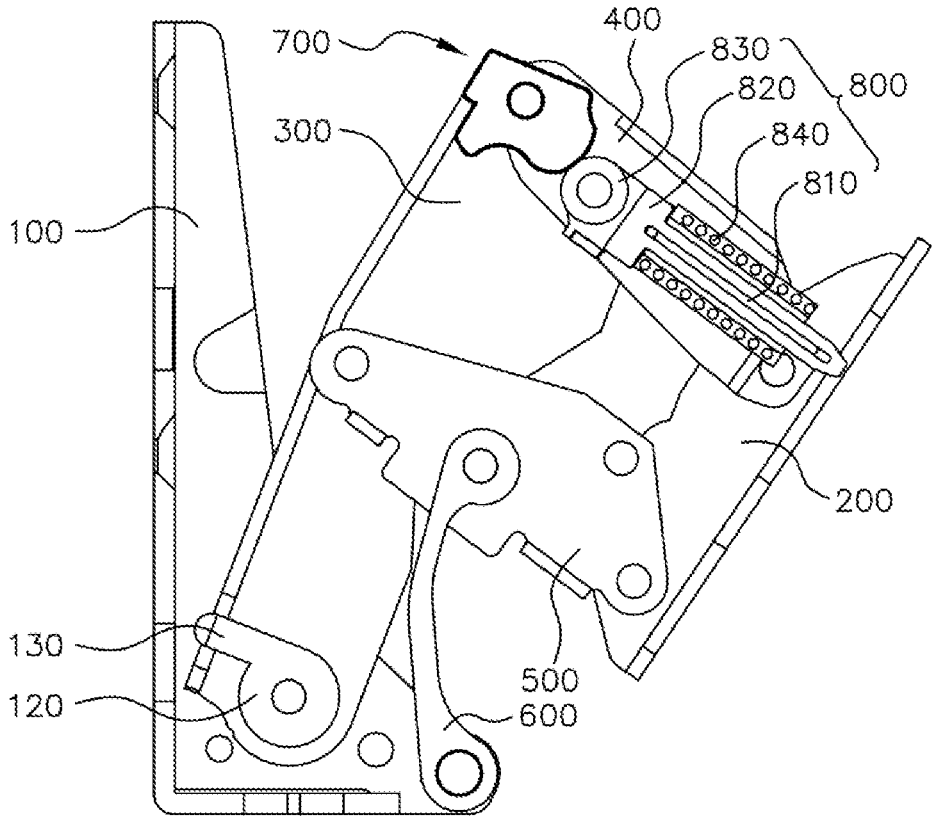

When the roller 830 is in a state before coming out of the first recessed portion 710 of the upper cam 700, as shown in FIG. 2, the spring 840 is compressed more than a compressed state in FIG. 1. Therefore, the user can detect that the door begins to be opened from the full-closed state.

FIG. 2 shows a state before the roller 830 came out of the first recessed portion 710 of the upper cam 700 and enters the first flat portion 730. According to the present disclosure, FIG. 2 is the state in which the door is opened at 33°.

Figure 3:
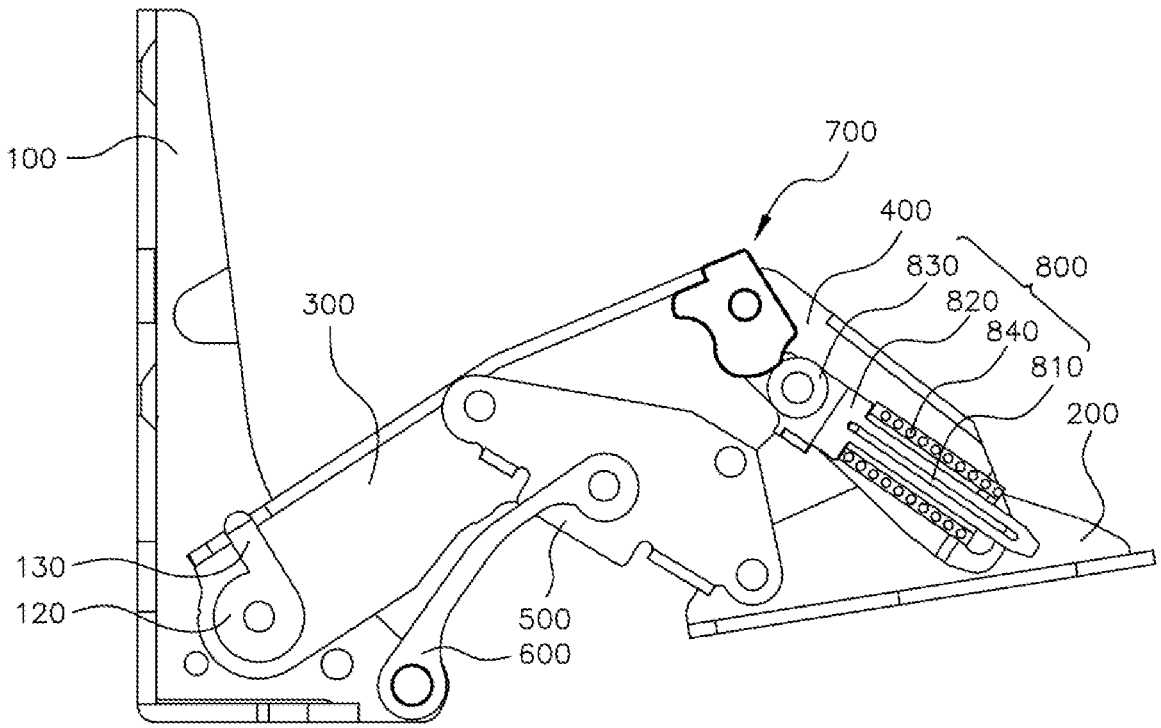

FIG. 3 shows a state in which the door is opened more and the roller 830 passed through the first flat portion 730 and is in before entering the second recessed portion 720. According to the present disclosure, FIG. 3 is the state in which the door is opened at 80°.

According to the present disclosure, as described above, the first flat portion 730 means the section where the radius of the upper cam 700 is not changed around the shaft connecting the body frame 300 to the inner link 400 in the co-rotatable manner. In the section, resilience of the spring 840 provided at the upper elastic member 800 is not changed.

As shown in FIG. 3, when the roller 830 passed through the first flat portion 730 and is in before entering the second recessed portion 720, the spring 840 provided in the upper elastic member 800 begins to expand whereby the user can detect that the door enters the full-open state.

Figure 4:
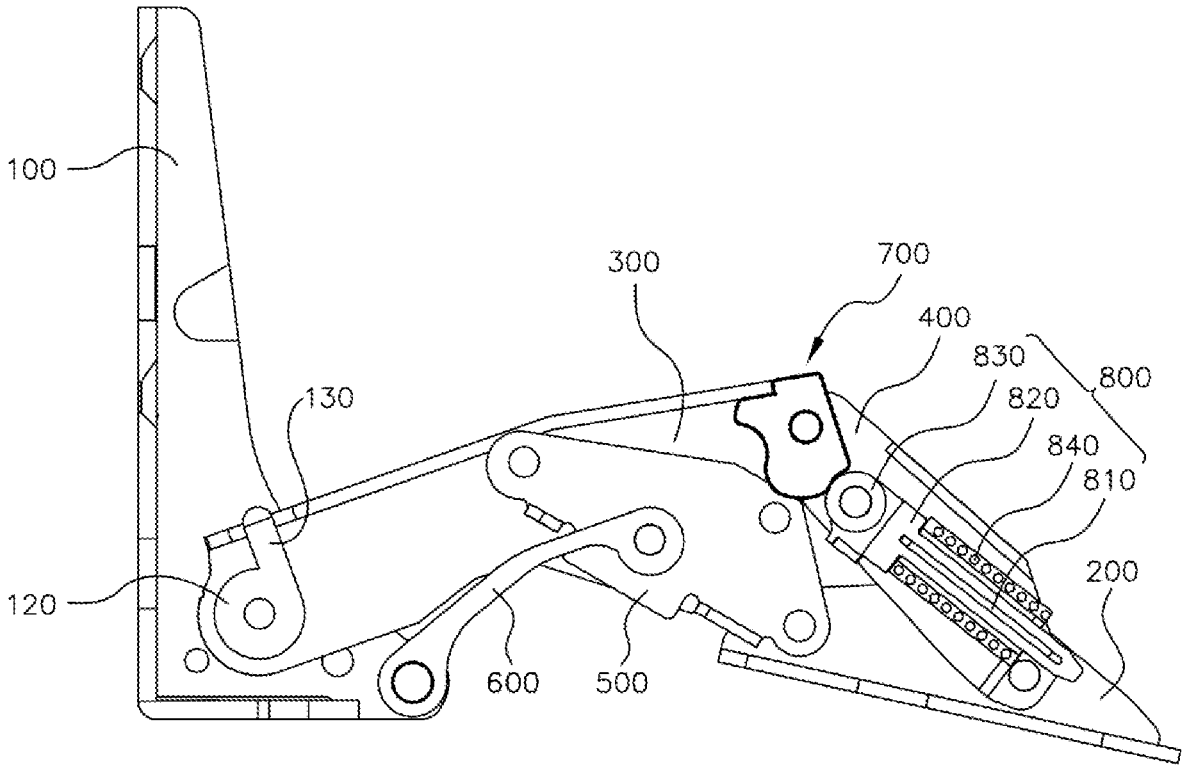

When the door is in the full-open state as shown in FIG. 4 and the roller 830 is seated on the second recessed portion 720, the spring 840 expands more than the state in FIG. 3, whereby the door maintains the full-open state. An opening angle in FIG. 4 is about 102°.

According to the present disclosure, within the opening angle of 33°, the roller 830 tends to be seated on the first recessed portion 710 due to resilience of the spring 840 provided in the upper elastic member 800, and as a result, the door tends to maintain the closed state. When the door opening angle is over 80°, the roller 830 tends to be seated on the second recessed portion 720 due to resilience of the spring 840 provided in the upper elastic member 800, and as a result, the door tends to maintain the open state.

Accordingly, the user can easily detect the door state before opening and closing the door. Furthermore, door opening and closing are easily performed using resilience of the spring 840 of the upper elastic member 800, thus providing convenience to the user.

Meanwhile, within the door opening angle from 33° to 80°, resilience of the spring 840 of the upper elastic member 800 is not changed. Therefore, when the user does not apply a force in a direction opening or closing the door, the door is not arbitrarily operated and maintains a present state.

On the other hand, referring to FIGS. 4 to 1, an operational process of closing the door according to the first embodiment of the present disclosure in the full-open state will be illustrated.

When the door is in the open state as shown in FIG. 4, the roller 830 tends to be seated on the second recessed portion 720 due to resilience of the spring 840 provided in the upper elastic member 800, and as a result, the door tends to maintain the open state continually. However, when the user pushes the door with a predetermined force, the roller 830 is separated from the second recessed portion 720 and rollably moved to the first flat portion 730, and as a result, the spring 840 provided in the upper elastic member 800 is compressed more than the state in FIG. 4.

When the door is closed more than the state in FIG. 3, the roller 830 is in the state before entering the first recessed portion 710 as shown in FIG. 2, and the spring 840 provided in the upper elastic member 800 begins to expands, whereby the user can detect that the door enters the full-open state.

When the door is in the state before fully closing, as shown in FIG. 1, the roller 830 tends to be seated on the first recessed portion 710 due to resilience of the spring 840 provided in the upper elastic member 800, and as a result, the door maintains the closed state.

According to the first embodiment of the present disclosure, the roller is rollably moved while elastically supporting an upper portion of the door frame 200, so that opening and closing motions of the door may be smoothly performed.

According to the present disclosure, a cylindrical cam 120 is securely provided on the shaft of the main body frame 100 and the body frame 300 at a portion between the first and second side portions of the sidewall of the body frame 300, as shown in FIG. 1. A bumper protrusion 130 protrudes on an outer circumferential surface of the cylindrical cam 120 along a tangential direction of the cylindrical cam 120 and is brought into contact with the angle plate of the main body frame 100 before the door is closed.

When the bumper protrusion 130 is brought into contact with the angle plate of the main body frame 100 before the door is closed, so that the cylindrical cam 120 generates force to rotate in a direction opposite to a rotating direction of the body frame 300 (door closing direction), so that an impact generated when the door is closed may be absorbed.

As described above, absorbing, by the cylindrical cam 120 and the bumper protrusion 130, an impact generated when the door is closed is also applied in second and third embodiments, which will be described below.

FIGS. 6 to 9 are sectional views stepwisely showing operational states of opening a multi-link door hinge according to a second embodiment of the present disclosure from a door state before closing.

As shown in the drawings, the multi-link door hinge of the present disclosure includes: the main body frame 100, the door frame 200, the body frame 300, the inner link 400, the outer link 500, the leaf spring link 600, a lower cam 900, and a lower elastic member 1000.

The multi-link door hinge according to the second embodiment of the present disclosure includes the lower cam 900 and the lower elastic member 1000 rather than the upper cam 700 and the upper elastic member 800 of the first embodiment. Hereinbelow, the structure thereof will be described in detail.

The lower cam 900 is provided in the leaf spring link 600 connected to the outer link 500. As shown in the left side of FIG. 6, a lower cam profile is formed on an outer circumference of the lower cam 900, and the lower cam profile consists of a third first recessed portion 910 detecting the full-closed state of the door in response to a closing motion of the door, a second recessed portion 920 detecting the full-open state of the door in response to an opening motion of the door, and a first flat portion 930 connecting the first recessed portion to the second recessed portion.

The lower cam 900 may be integrally formed in the leaf spring link 600 and may be separately from the leaf spring link 600 to be coupled to the leaf spring link 600.

According to the present disclosure, the multi-link door hinge includes a lower elastic member 800. The lower elastic member 800 has a first side portion provided at a portion connecting the door frame 200 to the outer link 500 and a second side portion coupled to the lower cam 900 in a slidingly movable manner and configured to elastically support the door frame 200.

Figure 10:
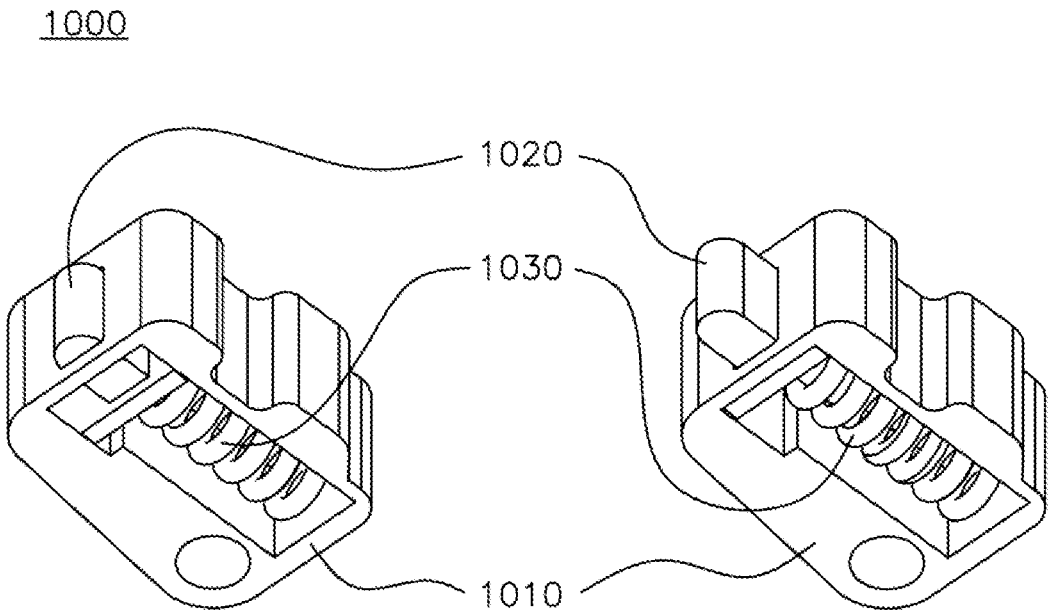
FIG. 10 is a detailed view showing a lower elastic member of the multi-link door hinge according to the second embodiment of the present disclosure.
Figure 11:
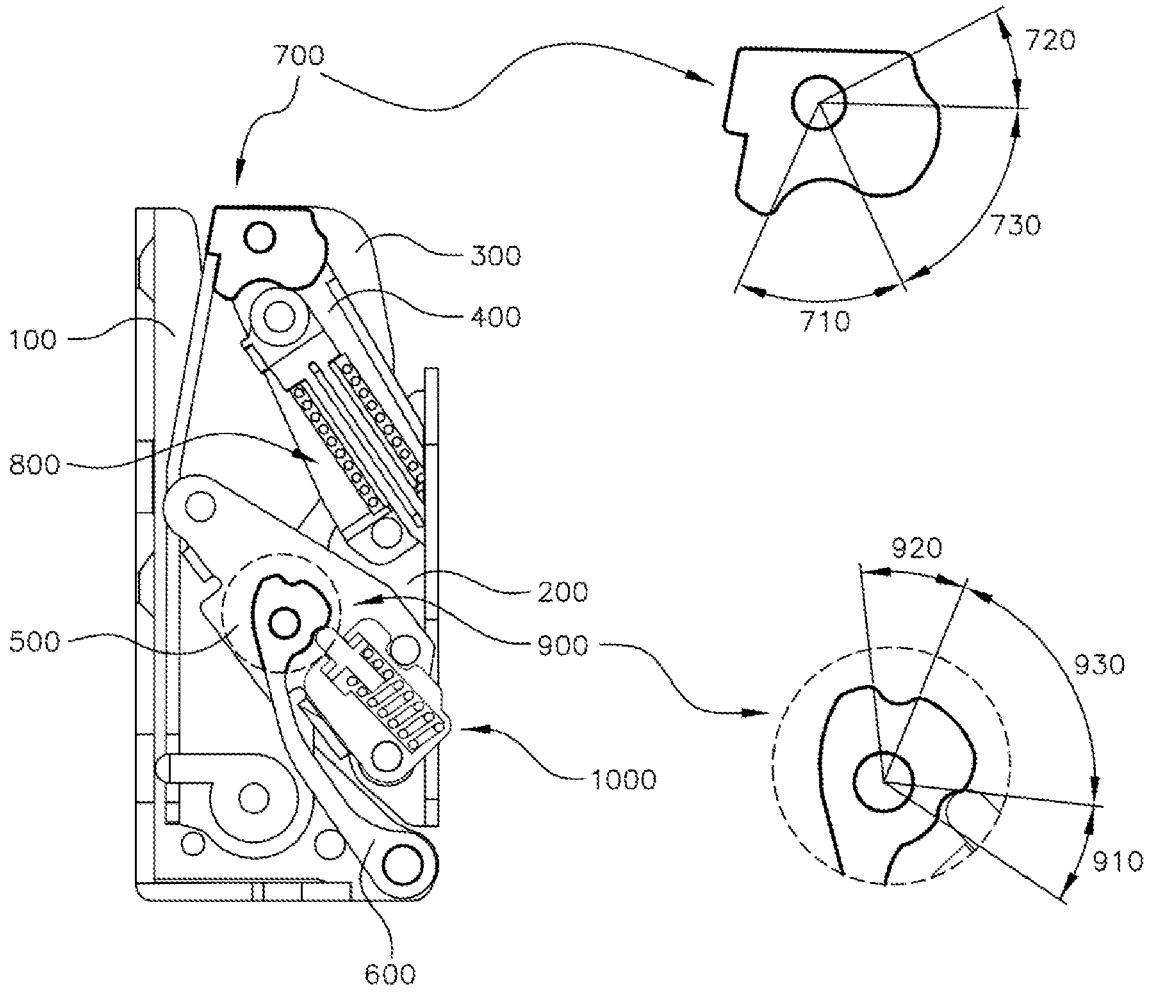
FIGS. 11 to 14 are sectional views stepwisely showing operational states of opening a multi-link door hinge according to a third embodiment of the present disclosure from the door state before closing.
Figure 12:
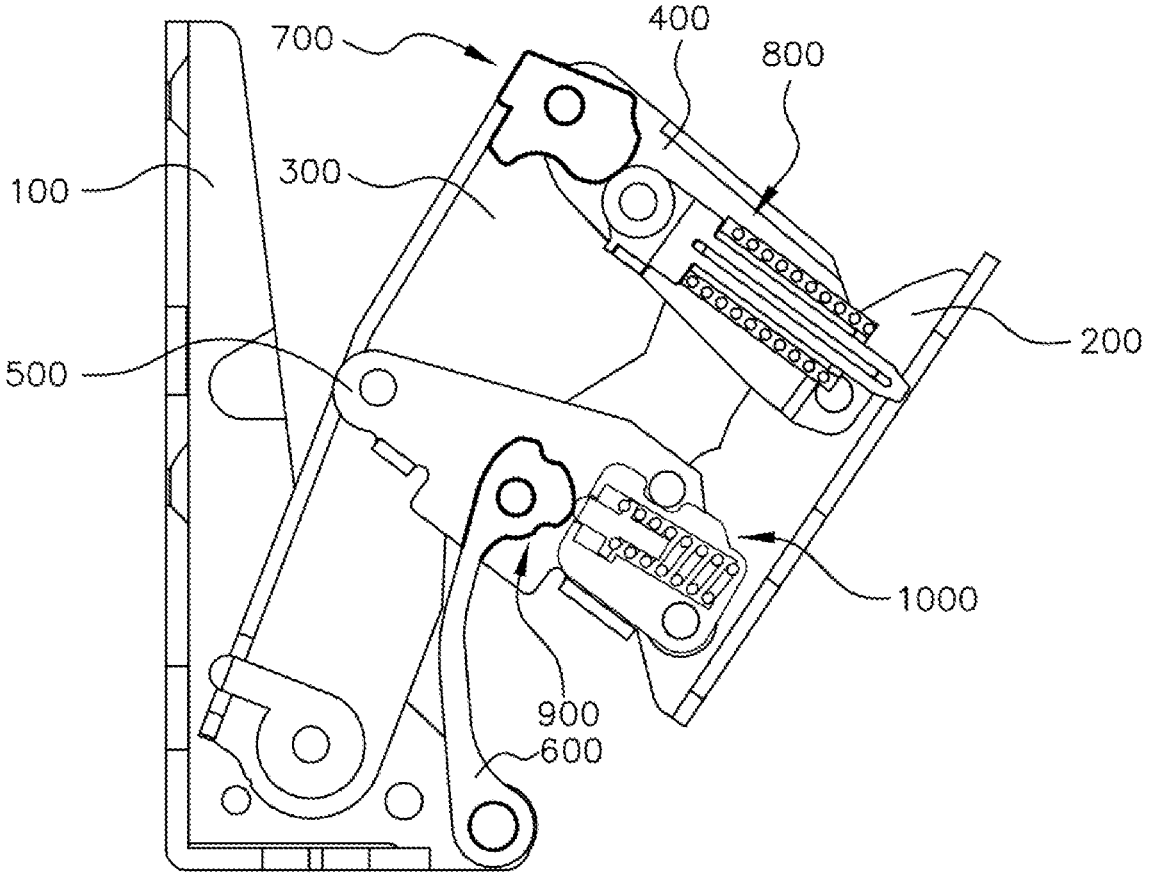
Figure 13:
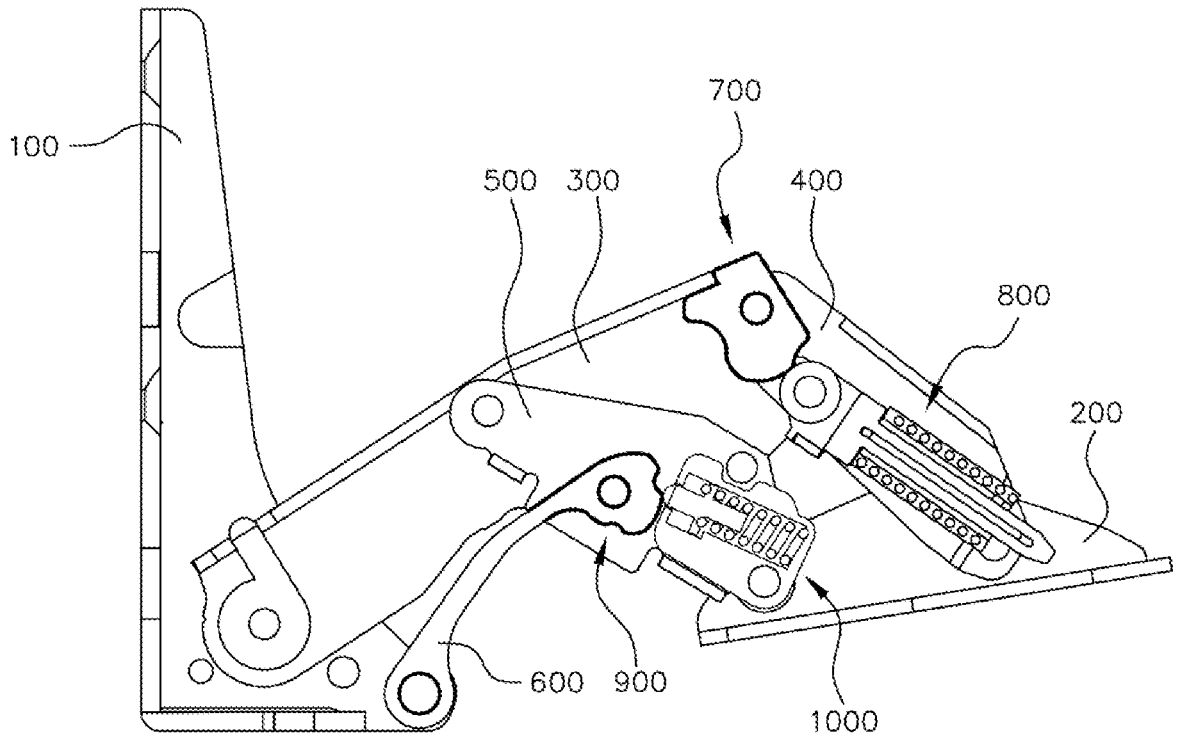
Figure 14:
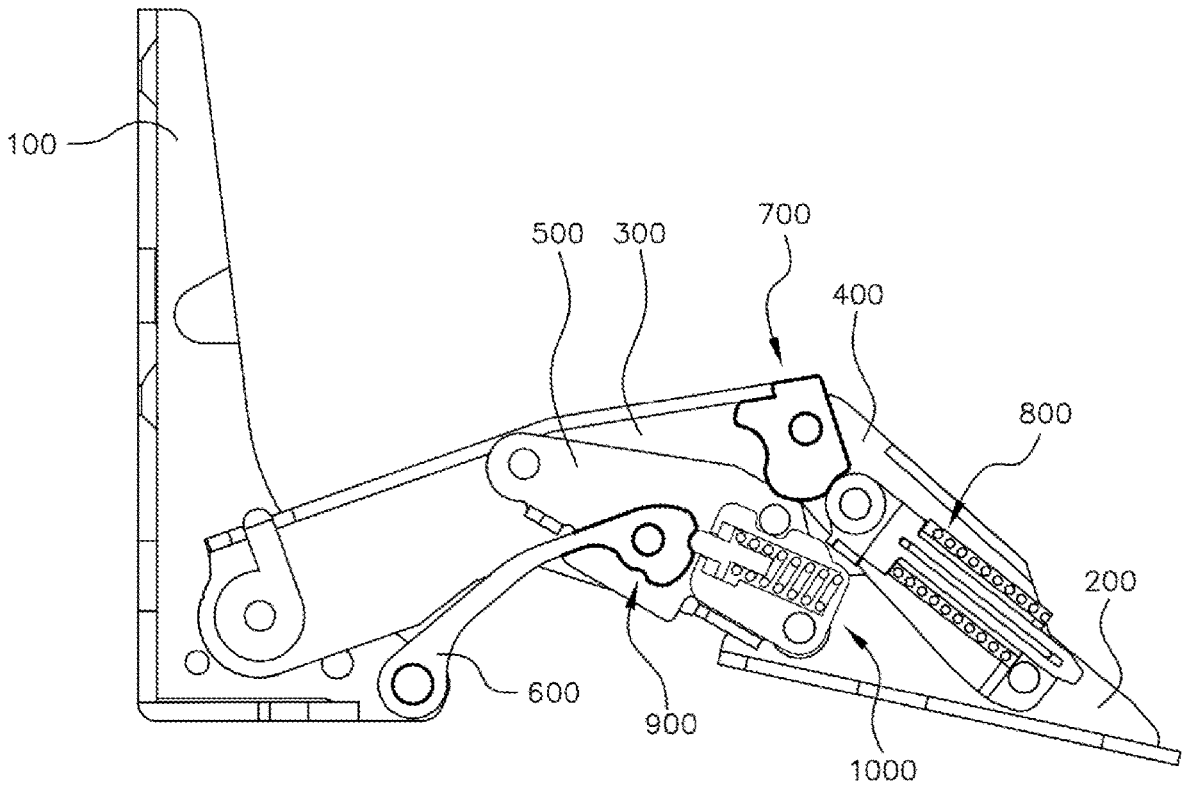

FIG. 10 is a detailed view showing a lower elastic member of the multi-link door hinge according to the second embodiment of the present disclosure.

As shown in the drawings, the lower elastic member 1000 may include a casing 1010, a locked portion 1020, and a spring 1030.

Figure 6:
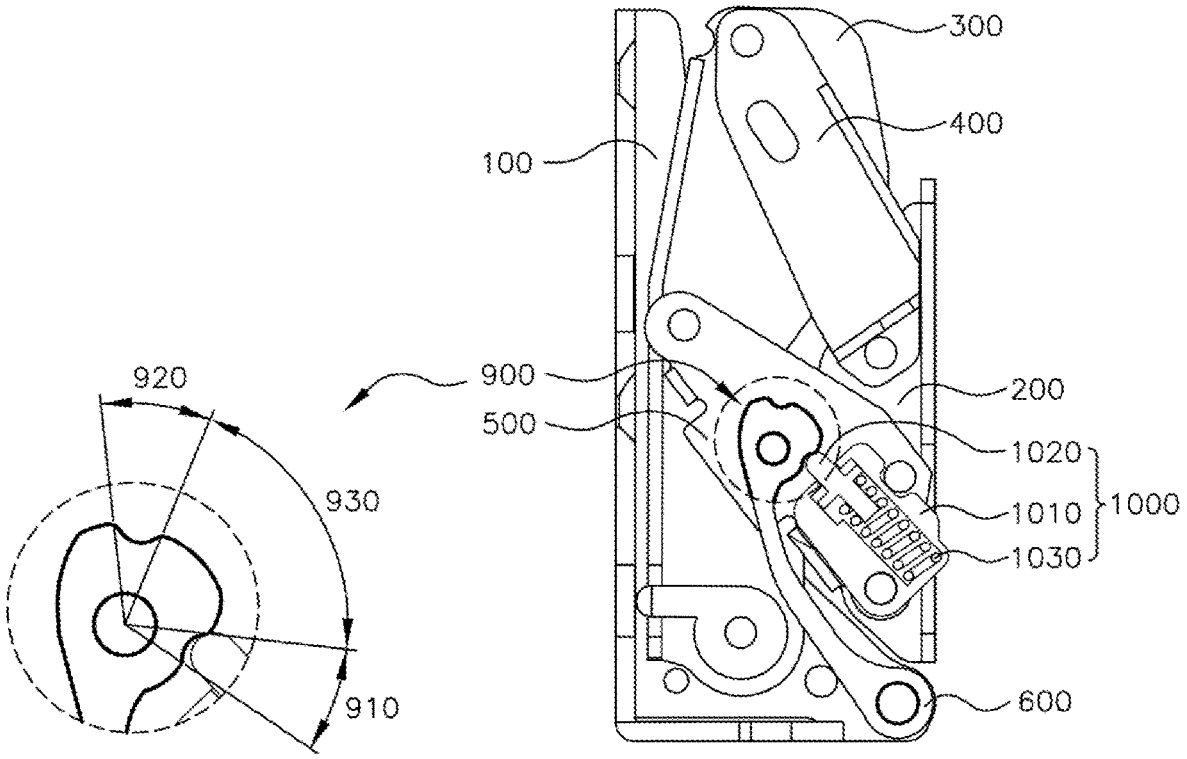
FIGS. 6 to 9 are sectional views stepwisely showing operational states of opening a multi-link door hinge according to a second embodiment of the present disclosure from the door state before closing.

In describing the lower elastic member 1000 with reference to FIG. 6, the casing 1010 has a first side portion provided at a portion connecting the door frame 200 to the outer link 500 and has a second side portion securely provided at the outer link 500. Therefore, the casing 1010 is capable of co-rotating with respect to the door frame 200, but is fixed to the outer link 500.

The locked portion 1020 is provided in the casing 1010 and an end thereof is coupled to the lower cam 900 in the slidingly movable manner. The locked portion 1020 has a first side portion supported by the casing 1010 and a second side portion elastically supported by the spring 1030, which is brought into close contact with the locked portion 1020, so as to receive a pushing force toward the lower cam 900.

During the opening and closing motions of the door, the locked portion 1020 of the lower elastic member 1000 is moved in the slidingly movable manner along the lower cam profile formed on the outer circumference of the lower cam 900. Therefore, the above operation allows the door to be opened and closed easily and the user to detect the door state before opening and closing the door, thus providing user convenience.

Therefore, the first recessed portion 910 and the second recessed portion 920 may be preferably formed in a curved-recessed shape. The first recessed portion 910 and the second recessed portion 920 may be preferably connected to each other by the first flat portion 930. The first flat portion 930 means a section where a radius of the lower cam 900 is not changed around a shaft connecting the outer link 500 to the leaf spring link 600 in the co-rotatable manner.

Based on the above description, an operational process of the multi-link door hinge according to the second preferred embodiment of the present disclosure will be described with reference to FIGS. 6 to 9.

As shown in FIG. 6, when the user pulls the door for opening the door, the body frame 300 is pulled by the inner link 400 and the outer link 500 rotatably connected to the door frame 200. Accordingly, the body frame 300 comes out of the main body frame 100, and the locked portion 1020 of the lower elastic member 1000 starts to come out of the first recessed portion 910 of the lower cam 900 simultaneously.

Figure 7:
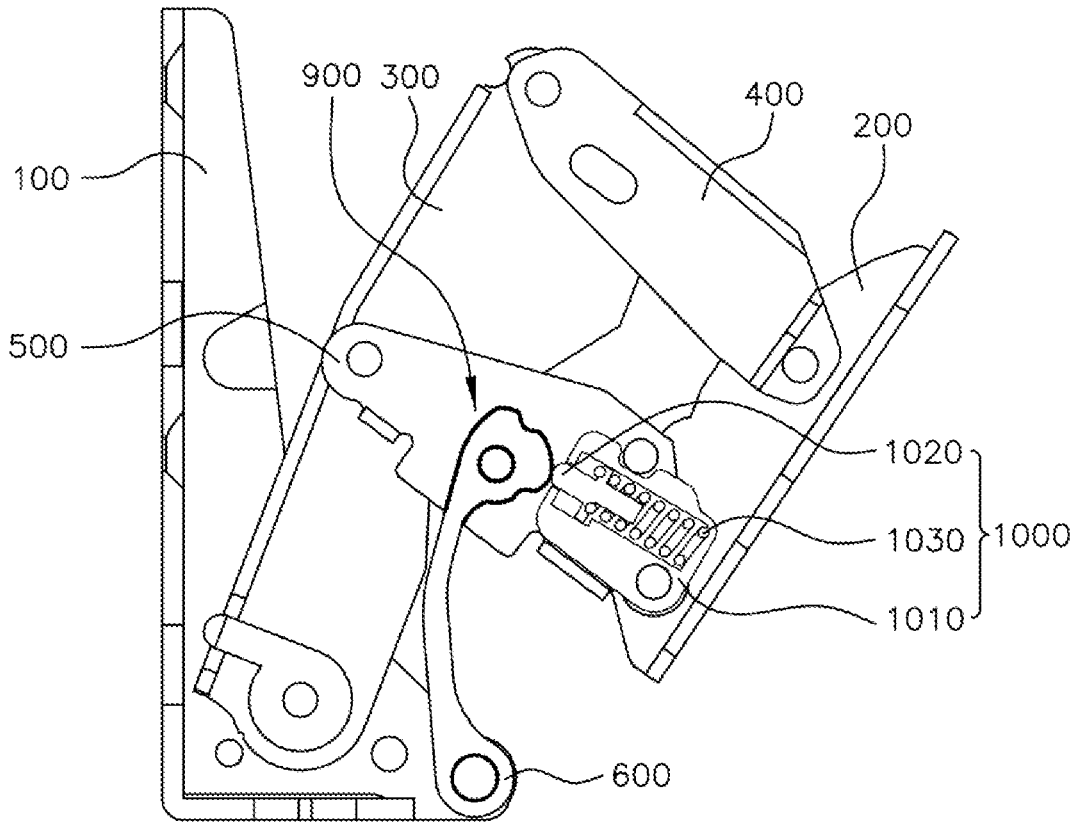

When the locked portion 1020 is in a state before coming out of the first recessed portion 910 of the lower cam 900, the spring 1030 is compressed, as shown in FIG. 7, more than a compressed state in FIG. 6. Therefore, the user can detect that the door has started to be opened from the full-closed state.

FIG. 7 shows a state before the locked portion 1020 came out of the first recessed portion 910 of the lower cam 900 and enters the first flat portion 930. According to the present disclosure, FIG. 7 is the state in which the door is opened about 33°.

Figure 8:
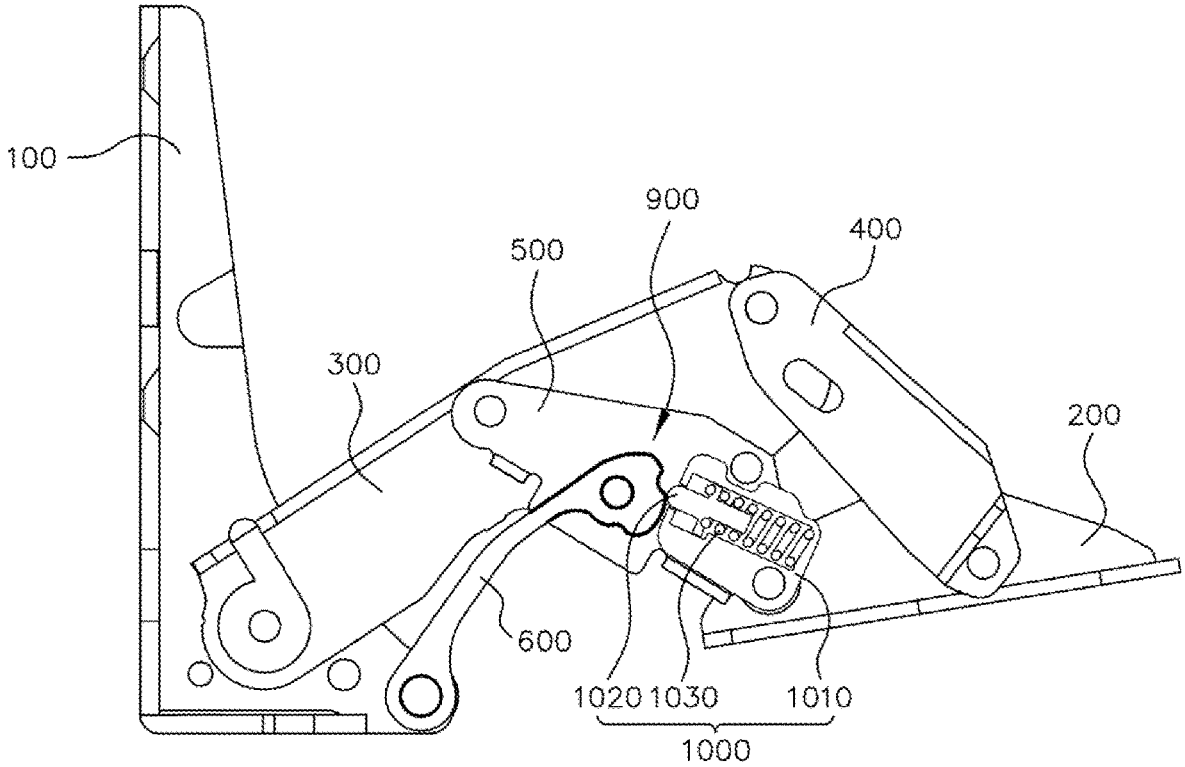

FIG. 8 shows a state in which the door is opened more and the locked portion 1020 passed through the first flat portion 930 and is in before entering the second recessed portion 920. According to the present disclosure, FIG. 8 is the state in which the door is opened about 80°.

According to the present disclosure, as described above, the second flat portion 930 means the section where the radius of the lower cam 900 is not changed around the shaft connecting the outer link 500 to the leaf spring link 600 in the co-rotatable manner. In the section, resilience of the spring 1030 provided at the lower elastic member 1000 is not changed.

As shown in FIG. 8, when the locked portion 1020 passed through the first flat portion 930 and is in before entering the second recessed portion 920, the spring 1030 provided in the lower elastic member 1000 begins to expand, whereby the user can detect that the door enters the full-open state.

Figure 9:
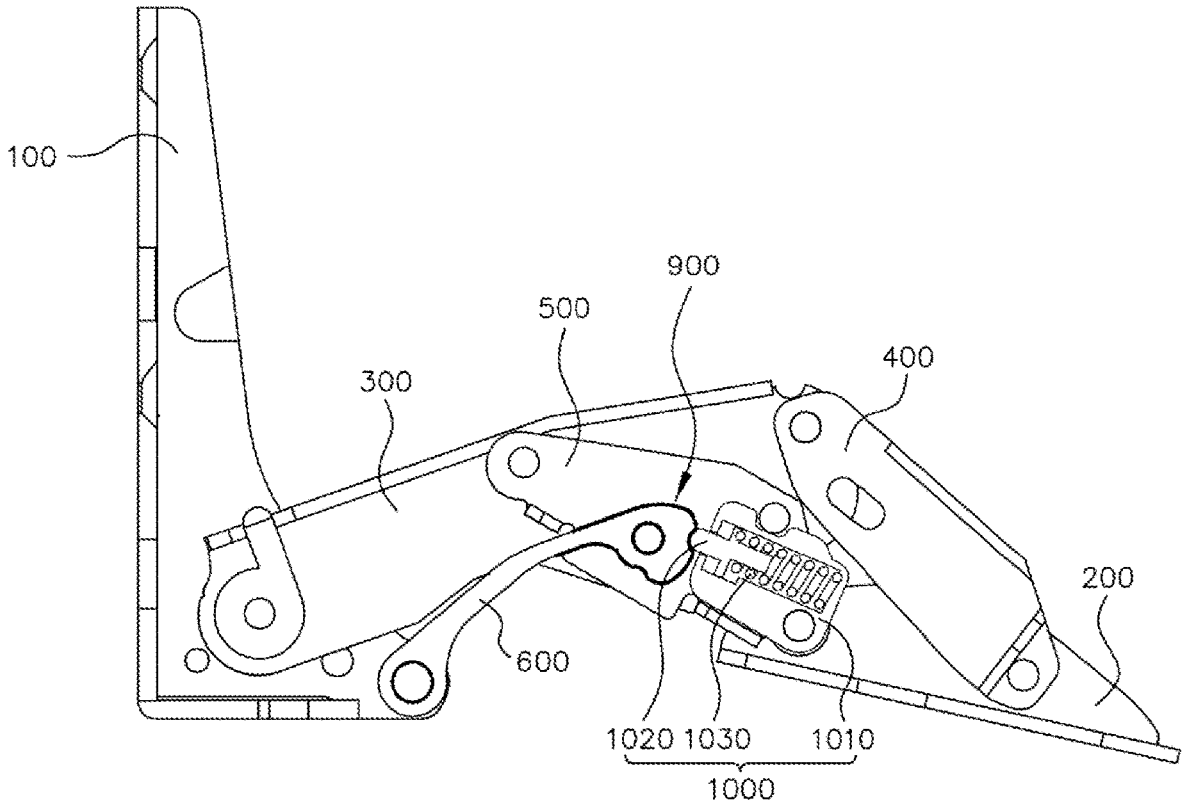

When the door is in the full-open state as shown in FIG. 9 and the locked portion 1020 is seated on the second recessed portion 920, the spring 1030 expands more than the state in FIG. 3, so that the door maintains the full-open state. An opening angle in FIG. 4 is about 102°.

According to the present disclosure, within the opening angle of 33°, the locked portion 1020 tends to be seated on the first recessed portion 910 due to resilience of the spring 1030 provided in the lower elastic member 1000, and as a result, the door tends to maintain the closed state. When the door opening angle is over 80°, the locked portion 1020 tends to be seated on the second recessed portion 920 due to resilience of the spring 1030 provided in the lower elastic member 1000, and as a result, the door tends to maintain the open state.

Accordingly, the user can easily detect the door state before opening and closing the door. Furthermore, opening and closing of the door are easily performed, thus providing convenience to the user.

Meanwhile, within the door opening angle from 33° to 80°, resilience of the spring 1030 of the lower elastic member 1000 is not changed. Therefore, when the user does not apply force in a direction opening or closing the door, the door is not arbitrarily operated and maintains a present state thereof.

On the other hand, referring to FIGS. 9 to 6, an operational process of closing the door according to the second embodiment of the present disclosure in the full-open state will be illustrated.

When the door is in the open state as shown in FIG. 9, the locked portion 1020 tends to be seated on the second recessed portion 920 due to resilience of the spring 1030 provided in the lower elastic member 1000, so that the door tends to maintain the open state continually. However, as shown in FIG. 8, when the user pushes the door with a predetermined force, the locked portion 1020 is separated from the second recessed portion 920 and rollably moved to the first flat portion 930, so that the spring 1030 provided in the lower elastic member 1000 is compressed further.

When the door is closed more than the state in FIG. 8, the locked portion 1020 is in before entering the first recessed portion 910, as shown in FIG. 7, and the spring 1030 provided in the lower elastic member 1000 begins to expands, whereby the user can detect that the door enters the full-open state.

When the door is in the state before fully closing as shown in FIG. 6, the locked portion 1020 tends to be seated on the first recessed portion 910 due to resilience of the spring 1030 provided in the lower elastic member 1000, and as a result, the door maintains the closed state.

According to the second embodiment of the present disclosure, the locked portion is rollably moved while elastically supporting a lower portion of the door frame, so that opening and closing motions of the door may be smoothly performed.

FIGS. 11 to 14 are sectional views stepwisely showing operational states of opening a multi-link door hinge according to a third embodiment of the present disclosure from a door state before closing.

As shown in the drawings, the multi-link door hinge of the present disclosure includes the main body frame 100, the door frame 200, the body frame 300, the inner link 400, the outer link 500, the leaf spring link 600, the upper cam 700 and the upper elastic member 800, and the lower cam and the lower elastic member 1000.

The third embodiment of the present disclosure includes both the upper cam 700 and the upper elastic member 800 of the first embodiment and the lower cam 900 and the lower elastic member 1000 of the second embodiment, and detailed descriptions thereof are the same as the above descriptions, so the detailed descriptions thereof will be omitted.

According to the third embodiment of the present disclosure, it may be expected to realize both the effect of the first embodiment in which the roller is rollably moved while elastically supporting the upper portion of the door frame so that opening and closing motions of the door are performed smooth, and the effect of the second embodiment in which the locked portion is moved in the slidingly movable manner while elastically supporting the lower portion of the door frame so that the opening and closing motions of the door are precisely performed, in the third embodiment.

As described above, the present disclosure is to provide the multi-link door hinge capable of facilitating opening and closing of a door and to provide various feelings to a user to detect opening and closing of the door as a basic technical spirit thereof.

Although the preferred embodiments of the present disclosure have been disclosed for illustrative purposes, those skilled in the art will appreciate that various modifications, additions and substitutions are possible, without departing from the spirit and scope of the present disclosure.

What is claimed is:

1. A multi-link door hinge comprising:

a main body frame provided in a main body of an apparatus having a door;

a door frame provided on the door;

a body frame rotatably connected to one side portion of the main body frame;

an inner link and an outer link rotatably connecting the door frame to the body frame;

a leaf spring link rotatably connecting the main body frame to the outer link;

an upper cam coupled to a portion connecting the body frame to the inner link in a co-rotatable manner, the upper cam being provided between first and second sidewall portions of the inner link to be securely coupled to the body frame; and an upper elastic member having a first side portion provided inside the inner link and a second side portion rollably coupled to the upper cam and configured to elastically support the door frame, wherein an upper cam profile is formed on an outer circumferential edge of the upper cam, the upper cam profile having a first recessed portion configured to detect a full-closed state of the door in response to a closing motion of the door, a second recessed portion configured to detect a full-open state of the door in response to an opening motion of the door, and a first flat portion connecting the first recessed portion to the second recessed portion, wherein a cylindrical cam is provided on a shaft of the main body frame and the body frame, and a bumper protrusion is formed on an outer circumferential surface of the cylindrical cam along a tangential direction and configured to be brought in contact with the main body frame before the door is closed.

2. A multi-link door hinge comprising:

a main body frame provided in a main body of an apparatus having a door;

a door frame provided on the door;

a body frame rotatably connected to one side portion of the main body frame;

an inner link and an outer link rotatably connecting the door frame to the body frame;

a leaf spring link rotatably connecting the main body frame to the outer link;

a lower cam provided in the leaf spring link connected to the outer link; and a lower elastic member having a first side portion provided at a portion connecting the door frame to the outer link and a second side portion coupled to the lower cam in a slidingly movable manner, and being configured to elastically support the door frame, an lower cam profile is formed on an outer circumferential edge of the lower cam, the lower cam profile having a first recessed portion configured to detect a full-closed state of the door in response to a closing motion of the door, a second recessed portion configured to detect a full-open state of the door in response to an opening motion of the door, and a first flat portion connecting the first recessed portion to the second recessed portion.

3. The multi-link door hinge of claim 2, wherein the lower elastic member comprises:

a casing having a first side portion provided at the portion connecting the door frame to the outer link and a second side portion fixed to the outer link;

a locked portion provided in the casing and coupled to the lower cam in a sliding-movable manner; and a spring provided in the casing, and configured to provide pushing force toward the lower cam while a first side portion thereof is supported by the casing and a second side portion thereof is in close contact with the locked portion.

4. The multi-link door hinge of claim 2, wherein a cylindrical cam is provided on a shaft of the main body frame and the body frame, and a bumper protrusion is formed on an outer circumferential surface of the cylindrical cam along a tangential direction and configured to be brought in contact with the main body frame before the door is closed.

5. A multi-link door hinge comprising:

a main body frame provided in a main body of an apparatus having a door;

a door frame provided on the door;

a body frame rotatably connected to one side portion of the main body frame;

an inner link and an outer link rotatably connecting the door frame to the body frame;

a leaf spring link rotatably connecting the main body frame to the outer link;

an upper cam coupled to a portion connecting the body frame to the inner link in a co-rotatable manner, the upper cam being provided between first and second sidewall portions of the inner link to be securely coupled to the body frame;

a lower cam provided in the leaf spring link connected to the outer link;

an upper elastic member having a first side portion provided inside the inner link and a second side portion rollably coupled to the upper cam, and being configured to elastically support the door frame; and a lower elastic member having a first side portion provided at a portion connecting the door frame to the outer link and a second side portion coupled to the lower cam in a slidingly movable manner, and being configured to elastically support the door frame, wherein an upper cam profile is formed on an outer circumferential edge of the upper cam, the upper cam profile having a first recessed portion configured to detect a full-closed state of the door in response to a closing motion of the door, a second recessed portion configured to detect a full-open state of the door in response to an opening motion of the door, and a first flat portion connecting the first recessed portion to the second recessed portion, and an lower cam profile is formed on an outer circumferential edge of the lower cam, the lower cam profile having a third recessed portion configured to detect a full-closed state of the door in response to a closing motion of the door, a fourth recessed portion configured to detect a full-open state of the door in response to an opening motion of the door, and a second flat portion connecting the third recessed portion to the fourth recessed portion.

6. The multi-link door hinge of claim 5, wherein the upper elastic member comprises:

a rod having a first side portion inserted into an installation hole provided in a fixation plate installed in the inner link;

a pair of roller brackets provided at a second side portion of the rod;

a roller rotatably provided between the roller brackets; and a spring inserted over the rod, and configured to provide pushing force toward the upper cam while a first side portion thereof is supported by the fixation plate and a second side portion thereof is in close contact with the pair of roller brackets.

7. The multi-link door hinge of claim 5, wherein the lower elastic member comprises:

a casing having a first side portion provided at the portion connecting the door frame to the outer link and a second side portion fixed to the outer link;

a locked portion provided in the casing and coupled to the lower cam in a sliding-movable manner; and a spring provided in the casing, and configured to provide pushing force toward the lower cam while a first side portion thereof is supported by the casing and a second side portion thereof is in close contact with the locked portion.

8. The multi-link door hinge of claim 5, wherein a cylindrical cam is provided on a shaft of the main body frame and the body frame, and a bumper protrusion is formed on an outer circumferential surface of the cylindrical cam along a tangential direction and configured to be brought in contact with the main body frame before the door is closed.

* * * * *